US011833636B2

(12) United States Patent
Watanabe et al.

(10) Patent No.: US 11,833,636 B2
(45) Date of Patent: Dec. 5, 2023

(54) SUBSTRATE POLISHING APPARATUS, METHOD OF CREATING THICKNESS MAP, AND METHOD OF POLISHING A SUBSTRATE

(71) Applicant: EBARA CORPORATION, Tokyo (JP)

(72) Inventors: Katsuhide Watanabe, Tokyo (JP); Yoichi Shiokawa, Tokyo (JP); Keita Yagi, Tokyo (JP); Akira Nakamura, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 307 days.

(21) Appl. No.: 17/028,072

(22) Filed: Sep. 22, 2020

(65) Prior Publication Data

US 2021/0101250 A1 Apr. 8, 2021

(30) Foreign Application Priority Data

Oct. 3, 2019 (JP) ..... 2019/182848

(51) Int. Cl.
*B24B 37/013* (2012.01)
*B24B 49/12* (2006.01)
*B24B 49/10* (2006.01)

(52) U.S. Cl.
CPC ..... *B24B 37/013* (2013.01); *B24B 49/12* (2013.01); *B24B 49/105* (2013.01)

(58) Field of Classification Search
CPC ... B24B 37/013; B24B 37/005; B24B 37/042; B24B 37/04; B24B 37/10; B24B 37/105;
(Continued)

(56) References Cited

U.S. PATENT DOCUMENTS 5,240,552 A * 8/1993 Yu ..... B24B 37/04 438/959
7,018,271 B2 3/2006 Wiswesser et al.
(Continued)

FOREIGN PATENT DOCUMENTS

EP 1618991 B1 * 1/2008 ..... B24B 37/005
JP 2013-107167 A 6/2013
(Continued)

OTHER PUBLICATIONS

U.S. Appl. No. 16/441,904; Non-Final Office Action; dated May 5, 2021; 24 pages.

*Primary Examiner* — Joel D Crandall
*Assistant Examiner* — Michael A Gump
(74) *Attorney, Agent, or Firm* — BakerHostetler

(57) ABSTRACT

To measure thickness in a polishing treatment more efficiently. A substrate polishing apparatus comprises a rotatably configured polishing table provided with a sensor that outputs a signal related to a thickness, a rotatably configured polishing head that faces the polishing table, a substrate being attachable to a face of the polishing head that faces the polishing table, and a controller. The controller acquires a signal from the sensor when the sensor passes over a surface to be polished of the substrate, specifies an orbit of the sensor with respect to the substrate on a basis of a profile of the signal, calculates a thickness of the substrate at each point on the orbit on a basis of the signal, and creates a thickness map on a basis of the calculated thickness at each point on a plurality of orbits of the sensor.

19 Claims, 16 Drawing Sheets

(58) Field of Classification Search
CPC ..... B24B 49/12; B24B 49/105; B24B 49/02; B24B 49/10; B24B 49/04; B24B 7/228; H01L 21/67092
USPC ..... 451/6
See application file for complete search history.

(56) References Cited

U.S. PATENT DOCUMENTS

| | | | | |
|---|---|---|---|---|
| 8,696,924 | B2 | 4/2014 | Tada et al. | |
| 2007/0224915 | A1* | 9/2007 | David | B24B 37/013 451/6 |
| 2013/0065493 | A1* | 3/2013 | Takahashi | B24B 49/105 451/259 |
| 2013/0273814 | A1 | 10/2013 | Kobayashi et al. | |
| 2014/0030956 | A1* | 1/2014 | Zhang | B24B 51/00 451/5 |
| 2014/0242878 | A1* | 8/2014 | Cherian | B24B 49/12 451/6 |
| 2015/0017887 | A1* | 1/2015 | Kobayashi | B24B 37/013 451/73 |
| 2015/0140907 | A1* | 5/2015 | Watanabe | B24B 37/04 451/73 |
| 2016/0059375 | A1* | 3/2016 | Ito | H01L 22/12 451/6 |
| 2018/0061032 | A1 | 3/2018 | Benvegnu | |

FOREIGN PATENT DOCUMENTS

| | | | | |
|---|---|---|---|---|
| JP | 2013-222856 | A | 10/2013 | |
| JP | 2015020242 | A * | 2/2015 | B24B 37/013 |
| WO | WO 2015/200098 | A1 | 12/2015 | |
| WO | WO 2015/200101 | A1 | 12/2015 | |

* cited by examiner

SUBSTRATE POLISHING APPARATUS, METHOD OF CREATING THICKNESS MAP, AND METHOD OF POLISHING A SUBSTRATE

TECHNICAL FIELD

The present invention relates to a substrate polishing apparatus, a method of creating a thickness map, and a method of polishing a substrate.

BACKGROUND ART

One apparatus used to manufacture semiconductor devices is a chemical mechanical polishing (CMP) apparatus. A typical CMP apparatus is provided with a polishing table to which a polishing pad is attached, and a polishing head to which a substrate is attached. In a typical CMP apparatus, a substrate is polished by supplying a polishing solution to the polishing pad and rotating at least one of the polishing table and the polishing head while putting the polishing pad and the substrate in contact with each other.

In a polishing step using a CMP apparatus, the film thickness of the polished substrate is measured by a thickness measuring instrument, and if the desired thickness or thickness profile has not been achieved, the substrate is polished again. PTL 1 is known as one example of a technology that detects whether or not a substrate has been polished a desired amount.

CITATION LIST

Patent Literature

PTL 1: Japanese Patent Laid-Open No. 2013-222856

SUMMARY OF INVENTION

Technical Problem

Typically, thickness measurement is performed using a special-purpose measuring device (for example, a measuring device installed together with the CMP apparatus), and because the measurement is time-consuming, thickness measurement is a factor contributing to lowered production efficiency in the CMP step. Consequently, there is a demand to make thickness measurement more efficient to raise the production efficiency of the CMP step.

Solution to Problem

To address the above problem, there is disclosed a substrate polishing apparatus comprising a rotatably configured polishing table provided with a sensor that outputs a signal related to a thickness, a rotatably configured polishing head that faces the polishing table, a substrate being attachable to a face of the polishing head that faces the polishing table, and a controller. The controller acquires a signal from the sensor when the sensor passes over a surface to be polished of the substrate, specifies an orbit of the sensor with respect to the substrate on a basis of a profile of the signal, calculates a thickness of the substrate at each point on the orbit on a basis of the signal, and creates a thickness map on a basis of the calculated thickness at each point on a plurality of orbits of the sensor.

DESCRIPTION OF EMBODIMENTS

Hereinafter, embodiments of the present invention will be described in detail and with reference to the drawings.

Figure 1A:
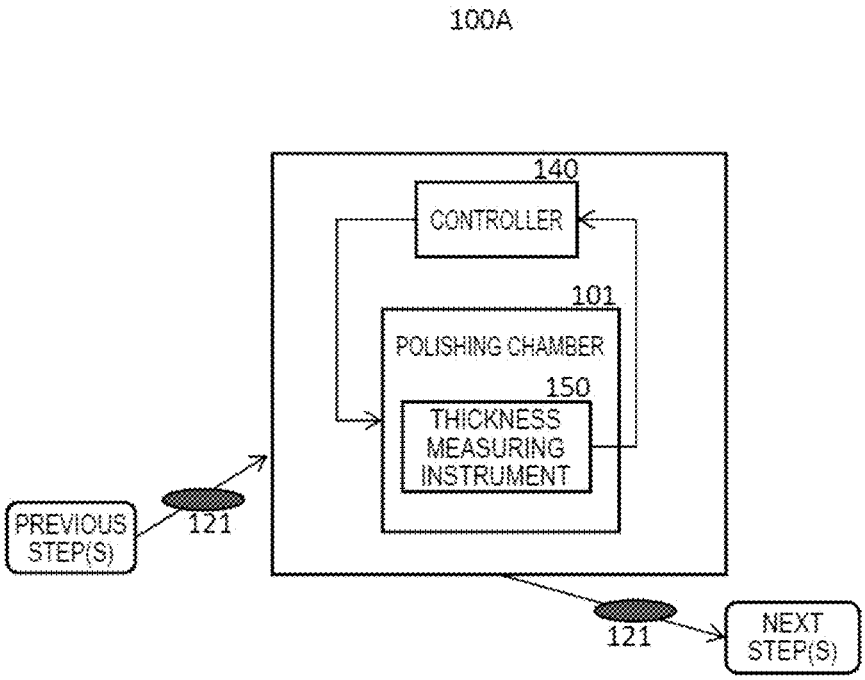
FIG. 1A is a schematic configuration diagram of a substrate polishing apparatus according to an embodiment.

FIG. 1A is a schematic configuration diagram of a substrate polishing apparatus 100A according to an embodiment. The substrate polishing apparatus 100A in the present embodiment is a CMP apparatus. The CMP apparatus 100A is provided with a polishing chamber 101 and a controller 140. A substrate 121 treated in previous steps is attached to a polishing table (not illustrated) inside the polishing chamber 101 and polished. The previous steps include a step of forming a thin film of a metal or an oxide for example on the substrate 121, and a step of forming a pattern on the substrate 121 by etching the thin film. The polishing table is provided with a thickness measuring instrument 150. During or after the polishing of the substrate 121, the thickness measuring instrument 150 generates a signal related to the thickness of the thin film on the substrate 121, and sends the generated signal to the controller 140. The controller 140 creates a thickness map expressing a thickness distribution on the substrate 121 on the basis of the signal. On the basis of the thickness map, the controller 140 may polish the substrate 121 further or optimize the parameters of subsequent polishing cycles (such as the pressure that presses the substrate 121 against the polishing table, the rotational speed of the polishing table and the polishing head that holds the substrate 121, the amount of slurry supplied to the surface of the substrate 121 to be polished, and the temperature of the surface of the substrate 121 to be polished). When the desired polishing is achieved, the substrate 121 is washed and dried inside a cleaning chamber (not illustrated) provided in the substrate polishing apparatus 100A, and then passed on to the next steps. The next steps include a step of forming an additional thin film on the substrate 121 and a step of dicing the substrate 121 into a plurality of chips, for example.

Figure 1B:
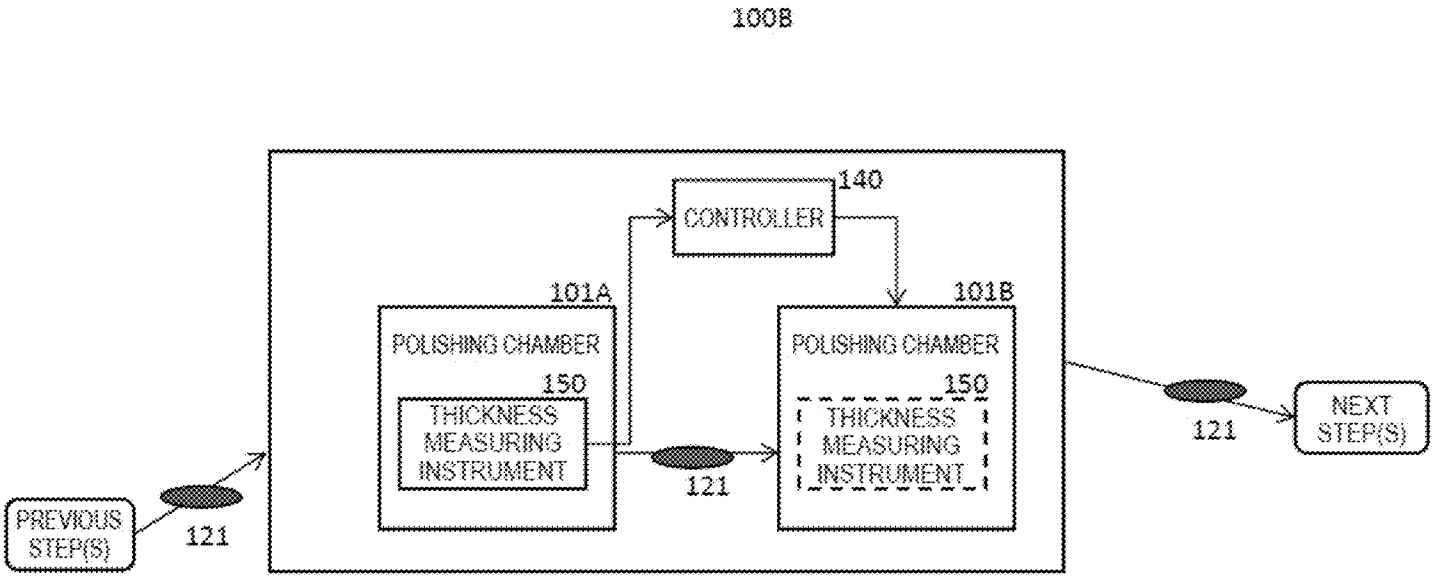
FIG. 1B is a schematic configuration diagram of a substrate polishing apparatus according to another embodiment.

FIG. 1B is a schematic configuration diagram of a substrate polishing apparatus 100B according to another embodiment. The substrate polishing apparatus 100B is a CMP apparatus, and is provided with two polishing chambers 101A and 101B. A substrate 121 is first polished in the polishing chamber 101A. A signal from a thickness measuring instrument 150 provided in the polishing chamber 101A is sent to the controller 140, and a thickness map is created. After the polishing in the polishing chamber 101A, the substrate 121 is sent to the polishing chamber 101B. The controller 140 polishes the substrate 121 further in the polishing chamber 101B on the basis of the thickness map.

Figure 1C:
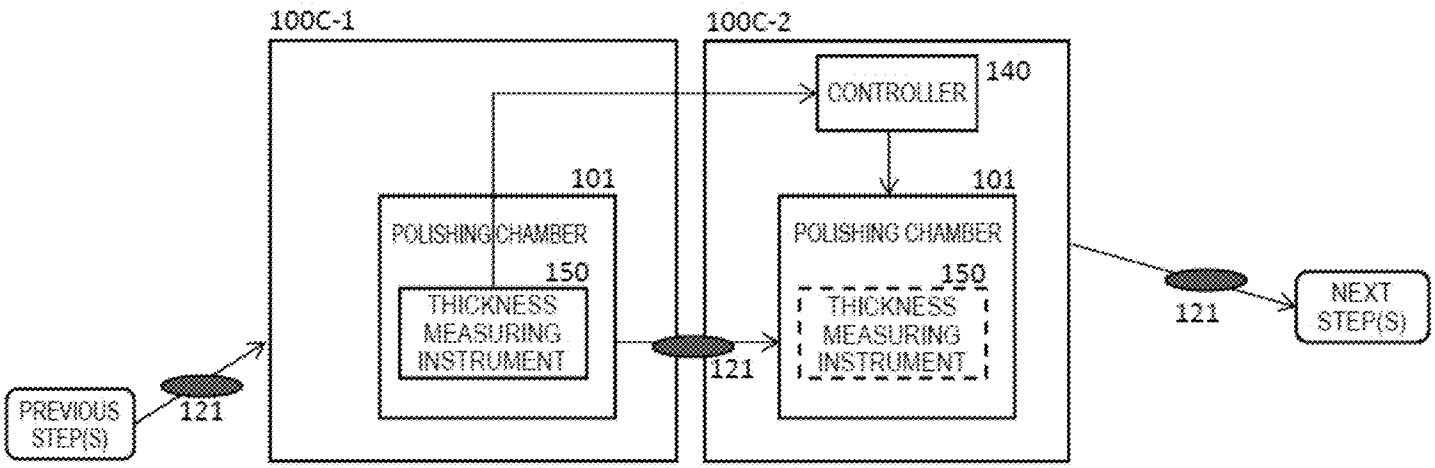
FIG. 1C is a diagram illustrating a substrate polishing apparatus according to yet another embodiment.

FIG. 1C illustrates substrate polishing apparatuses 100C-1 and 100C-2 according to yet another embodiment. The first substrate polishing apparatus 100C-1 is a CMP apparatus. The second substrate polishing apparatus 100C-2 may be a CMP apparatus or a different type of polishing apparatus. The substrate 121 is first polished in a polishing chamber 101 of the CMP apparatus 100C-1. A signal from a thickness measuring instrument 150 provided in the polishing chamber 101 of the CMP apparatus 100C-1 is sent to the controller 140, and a thickness map is created. Note that the controller 140 may be provided in either of the substrate polishing apparatuses 100C-1 and 100C-2. After the polishing in the CMP apparatus 100C-1, the substrate 121 is sent to the second substrate polishing apparatus 100C-2. The controller 140 polishes the substrate 121 further in the polishing chamber 101 of the second substrate polishing apparatus 100C-2 on the basis of the thickness map.

Figure 2:
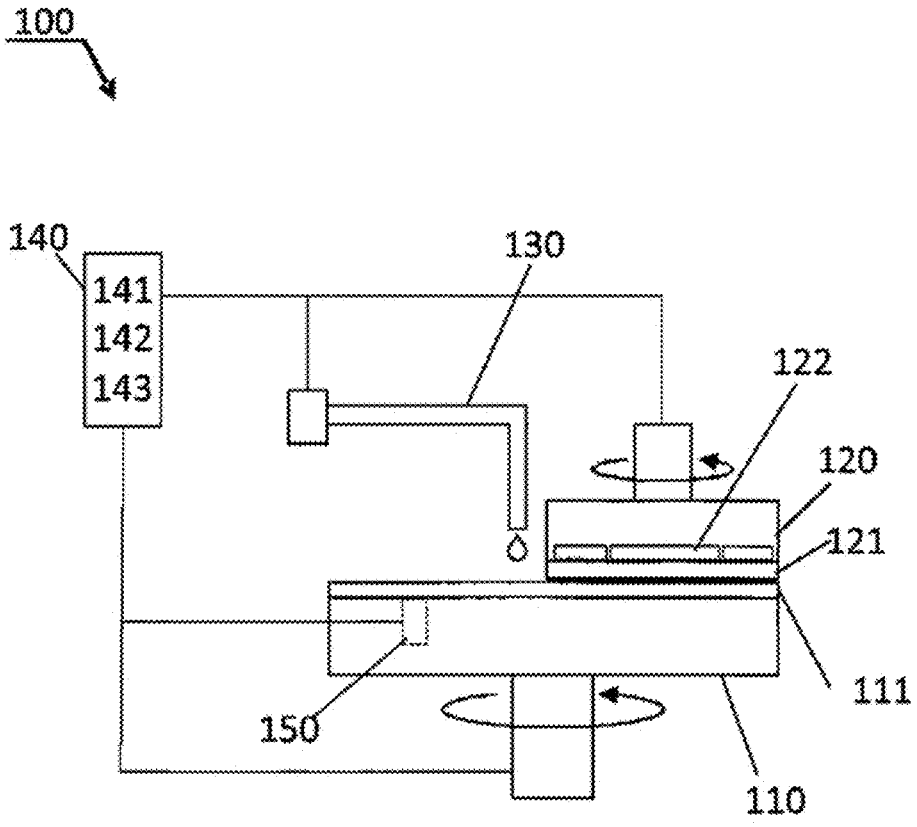
FIG. 2 is a front view of the substrate polishing apparatus according to the embodiment.

FIG. 2 is a front view of the substrate polishing apparatus 100 according to the embodiment. The substrate polishing apparatus 100 illustrated in FIG. 2 corresponds to any of the substrate polishing apparatuses 100A, 100B, 100C-1, and 100C-2 in FIGS. 1A, 1B, and 1C. The substrate polishing apparatus 100 in FIG. 2 is a CMP apparatus. However, the substrate polishing apparatus 100 is not limited to a CMP apparatus. It is sufficient for the substrate polishing apparatus 100 to be an apparatus that polishes a substrate by rotating a polishing table provided with an eddy current sensor.

The CMP apparatus 100 is provided with a polishing table 110, a polishing head 120, and a liquid supplying mechanism 130. The CMP apparatus 100 is additionally provided with a controller 140 for controlling each component. The controller 140 is provided with a storage device 141, a processor 142, and an input/output device 143, for example.

A polishing pad 111 is removably attached to the top surface of the polishing table 110. Here, the "top surface" of the polishing table 110 is a term referring to the surface of the polishing table 110 that faces the polishing head 120. Consequently, the "top surface" of the polishing table 110 is not limited to the "surface positioned on top in the vertical direction". The polishing head 120 is provided facing the polishing table 110. A substrate 121 is removably attached to the surface of the polishing head 120 that faces the polishing table 110. The liquid supplying mechanism 130 is configured to supply a polishing solution such as a slurry to the polishing pad 111. Note that the liquid supplying mechanism 130 may also be configured to supply liquids other than a polishing solution, such as a cleaning solution or a chemical solution.

The substrate polishing apparatus 100 is capable of using a vertical movement mechanism not illustrated to lower the polishing head 120 and bring the substrate 121 into contact with the polishing pad 111. However, the vertical movement mechanism may also be capable of moving the polishing table 110 vertically. The polishing table 110 and the polishing head 120 are made to rotate by a device such as a motor not illustrated. The CMP apparatus 100 polishes the substrate 121 by rotating both the polishing table 110 and the polishing head 120 while the substrate 121 and the polishing pad 111 are in contact with each other.

The CMP apparatus 100 is further provided with an airbag 122 partitioned into a plurality of concentric compartments. The airbag 122 is provided on the polishing head 120. The airbag 122 may also be provided on the polishing table 110 instead of or in addition to the airbag 122 provided on the polishing head 120. The airbag 122 is a member for adjusting the polishing pressure of the substrate 121 in different areas of the substrate 121. The airbag 122 is configured to change in volume depending on the pressure of air introduced internally. Note that although the term "air" bag is used, a fluid other than air, such as nitrogen gas or pure water for example, may also be introduced into the airbag 122.

An eddy current sensor 150 is provided inside the polishing table 110. Specifically, the eddy current sensor 150 is installed at a position passing through the center of the substrate 121 being polished. The eddy current sensor 150 corresponds to the thickness measuring instrument 150 in FIGS. 1A, 1B, and 1C. The eddy current sensor 150 induces an eddy current in a conductive layer at the surface of the substrate 121. The eddy current sensor 150 additionally detects the thickness of the conductive layer at the surface of the substrate 121 from changes in the impedance caused by a magnetic field produced by the eddy current.

Here, the magnitude of the signal output by the eddy current sensor 150 also changes according to factors other than the thickness of the conductive layer at the surface of the substrate 121. Factors that affect the magnitude of the signal output by the eddy current sensor 150 include the density and the width of interconnects formed on the substrate 121 as well as the presence or absence of lower-layer interconnects, for example. Consequently, to detect the thickness of the thin film on the substrate 121 precisely, the factors that affect the magnitude of the signal output by the eddy current sensor 150 must be considered. Note that herein, "lower-layer interconnects" refer to interconnects that are not exposed on the surface of the substrate 121. Consequently, in FIG. 2, interconnects positioned lower in the vertical direction of FIG. 2 are lower-layer interconnects. However, depending on the attitude of the substrate 121, the "lower-layer" interconnects are not necessarily positioned lower in the vertical direction. Furthermore, the shape of the interconnects is not particularly limited.

The factors that affect the magnitude of the signal (as described above, factors such as the density and the width of interconnects as well as the presence or absence of lower-layer interconnects, for example) may change depending on the location on the substrate 121. Consequently, to detect the thickness of the thin film on the substrate 121 precisely using the eddy current sensor 150, the location on the substrate 121 that is measured by the eddy current sensor 150 must be specified. In other words, to detect the thickness of the thin film on the substrate 121 precisely using the eddy current sensor 150, the orbit of the eddy current sensor 150 as seen from the substrate 121 must be specified.

Figure 3:
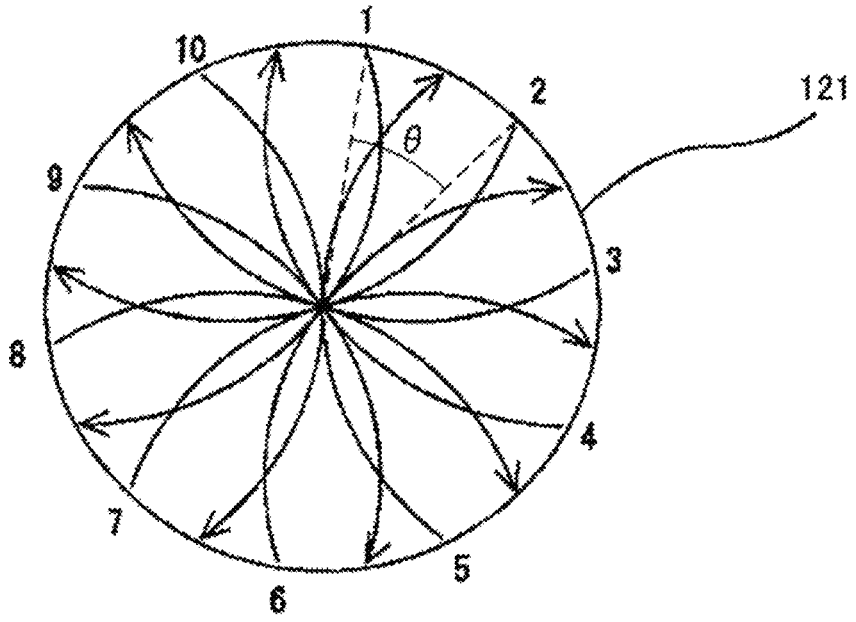
FIG. 3 is a diagram illustrating orbits on a substrate of an eddy current sensor as seen from the substrate.

Here, in the case that is free from any type of error such as dimensional error in each component, assembly error, and error in the rotational speed (hereinafter referred to as "ideal conditions") and also in the case where the rotational speed of the polishing table 110 and the rotational speed of the polishing head 120 are a predetermined combination, the orbit of the eddy current sensor 150 as seen from the substrate is limited to a few paths. As an example, in the case where the rotational speed of the polishing table 110 is 70 rpm (70 $min^{-1}$) and the rotational speed of the polishing head 120 is 77 rpm (11 $min^{-1}$), the orbits on the substrate 121 of the eddy current sensor 150 as seen from the substrate 121 is the one illustrated in FIG. 3. FIG. 3 is a view seen from the surface of the substrate 121, and the orbits of the eddy current sensor 150 are illustrated as solid-line arrows. Under these conditions, the orbit of the eddy current sensor 150 rotates 36 times for every rotation of the polishing table 110. In other words, an interval θ between the orbits of the eddy current sensor 150 as seen from the substrate 121 is 36 degrees. Consequently, there are 10 orbits in this case (360 (degrees)/36 (degrees/orbit)=10 (orbits)). Note that the signs "1" to "10" indicated in FIG. 3 are signs labeling the orbits of the first to tenth orbits of the eddy current sensor 150.

Note that in reality, the CMP apparatus 100 is not necessarily in ideal conditions. Also, the rotational speed of the polishing table 110 and the rotational speed of the polishing head 120 are not necessarily constant. Depending on the polishing process, the rotational speed of the polishing table 110 and the rotational speed of the polishing head 120 may also be changed while polishing the substrate 121. Consequently, the orbits of the eddy current sensor 150 may differ from those illustrated in FIG. 3.

Note that a plurality of eddy current sensors 150 may also be distributed throughout the polishing table 110. The plurality of eddy current sensors 150 follow respectively different orbits on the substrate 121 at the same time. Consequently, by using the signals from the plurality of eddy current sensors 150 at the same time, the time taken to create a thickness map according to the method described later can be shortened.

Figure 4:
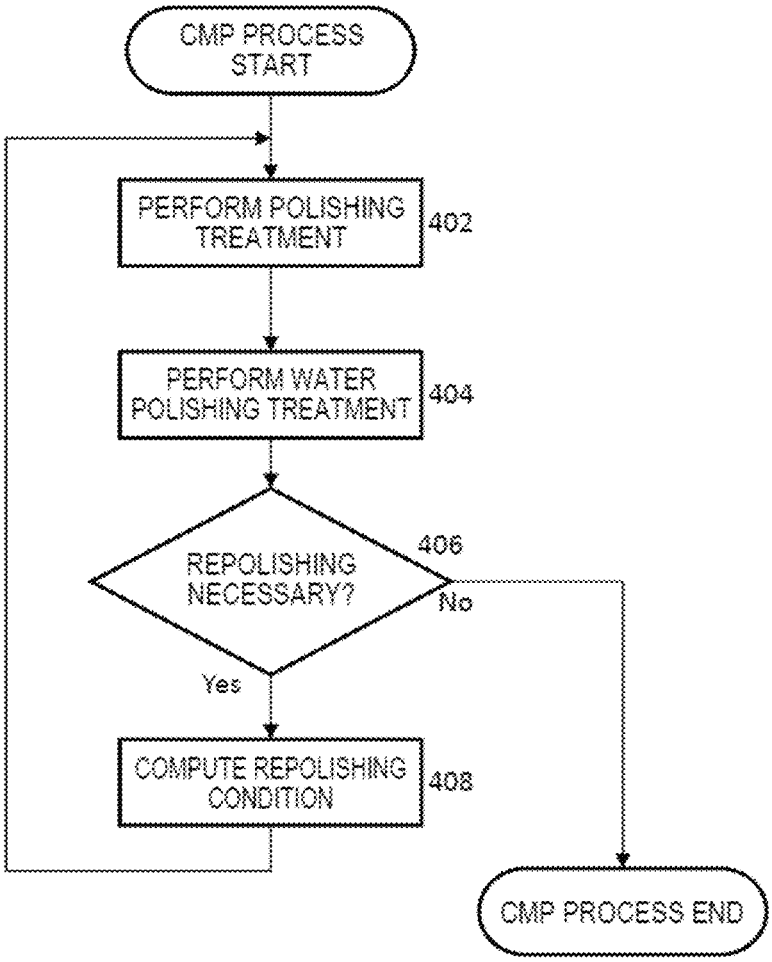
FIG. 4 is a flowchart illustrating overall operations by the substrate polishing apparatus according to the embodiment.

FIG. 4 is a flowchart illustrating overall operations by the substrate polishing apparatus 100 according to the embodiment.

In step 402, a polishing treatment is performed. Specifically, the substrate 121 is attached to the polishing head 120, and a slurry is supplied from the liquid supplying mechanism 130. With the substrate 121 pressed against the polishing table 110 by the polishing head 120, the polishing table 110 and the polishing head 120 are both made to rotate, and the substrate 121 is polished. During the polishing, a "polishing thickness map" is created on the basis of the output signal from the eddy current sensor 150. The polishing treatment in step 402 is continued until a predetermined end condition is satisfied, such as until a preset polishing time for polishing the film targeted by the polishing by a certain amount elapses, for example. When the polishing treatment ends, the flow proceeds to step 404.

In step 404, a water polishing treatment is performed. Specifically, water or pure water (hereinafter simply referred to as water) is supplied from the liquid supplying mechanism 130 instead of the slurry. While the water is being supplied from the liquid supplying mechanism 130, the polishing table 110 and the polishing head 120 continue to rotate. The slurry is washed away and removed by the water, and the polished surface of the substrate 121 is cleaned. Because the slurry is removed, the substrate 121 is substantially not polished during the water polishing, or the polishing rate is greatly lowered compared to the polishing in step 402. During the water polishing, a "water polishing thickness map" is created on the basis of the output signal from the eddy current sensor 150. The water polishing treatment in step 404 is continued for a preset time that is long enough to wash away the slurry sufficiently, for example. When the water polishing treatment ends, the flow proceeds to step 406.

In step 406, it is determined whether or not a repolishing treatment of the substrate 121 is necessary, on the basis of the created thickness maps. For example, it is determined whether or not a desired thickness or thickness profile has been achieved throughout the entire surface of the substrate 121 or in at least a portion of the substrate 121. In the case where the desired thickness or thickness profile has not been achieved, the repolishing treatment is determined to be necessary, and the flow proceeds to step 408. On the other hand, in the case where the desired thickness or thickness profile has been achieved, the operations by the substrate polishing apparatus 100 end. Note that while step 406 is being performed, the water polishing treatment may be continued by continuing the rotation of the polishing table 110 and the polishing head 120 and also continuing to supply water or pure water from the liquid supplying mechanism 130. Also, while step 406 is being performed, the polishing head 120 may be raised up briefly and separated from the polishing table 110.

In step 408, a repolishing condition is computed. For example, the duration of the polishing in the repolishing treatment is set on the basis of the thickness maps. Also, on the basis of the thickness maps, the controller 140 may increase or decrease the internal pressure of the airbag 122, raise the polishing pressure in thick areas (that is, areas where the polishing progress is low), and lower the polishing pressure in thin areas (that is, areas where the polishing progress is high). By this control, the polished state of the substrate 121 can be made uniform. The polishing treatment in step 402 is performed again in accordance with the repolishing condition computed in this way.

Figure 5:
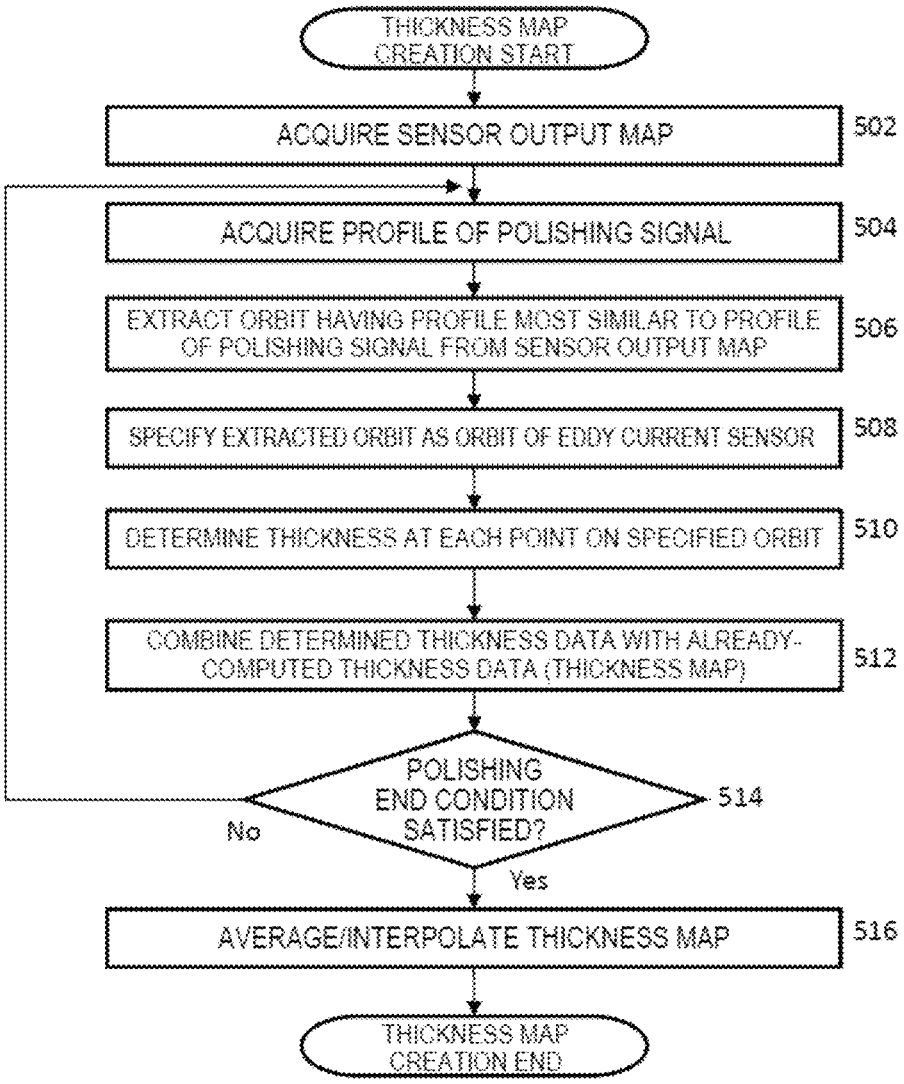
FIG. 5 is a flowchart illustrating a method of creating a water polishing thickness map during a water polishing treatment according to the embodiment.
Figure 6:
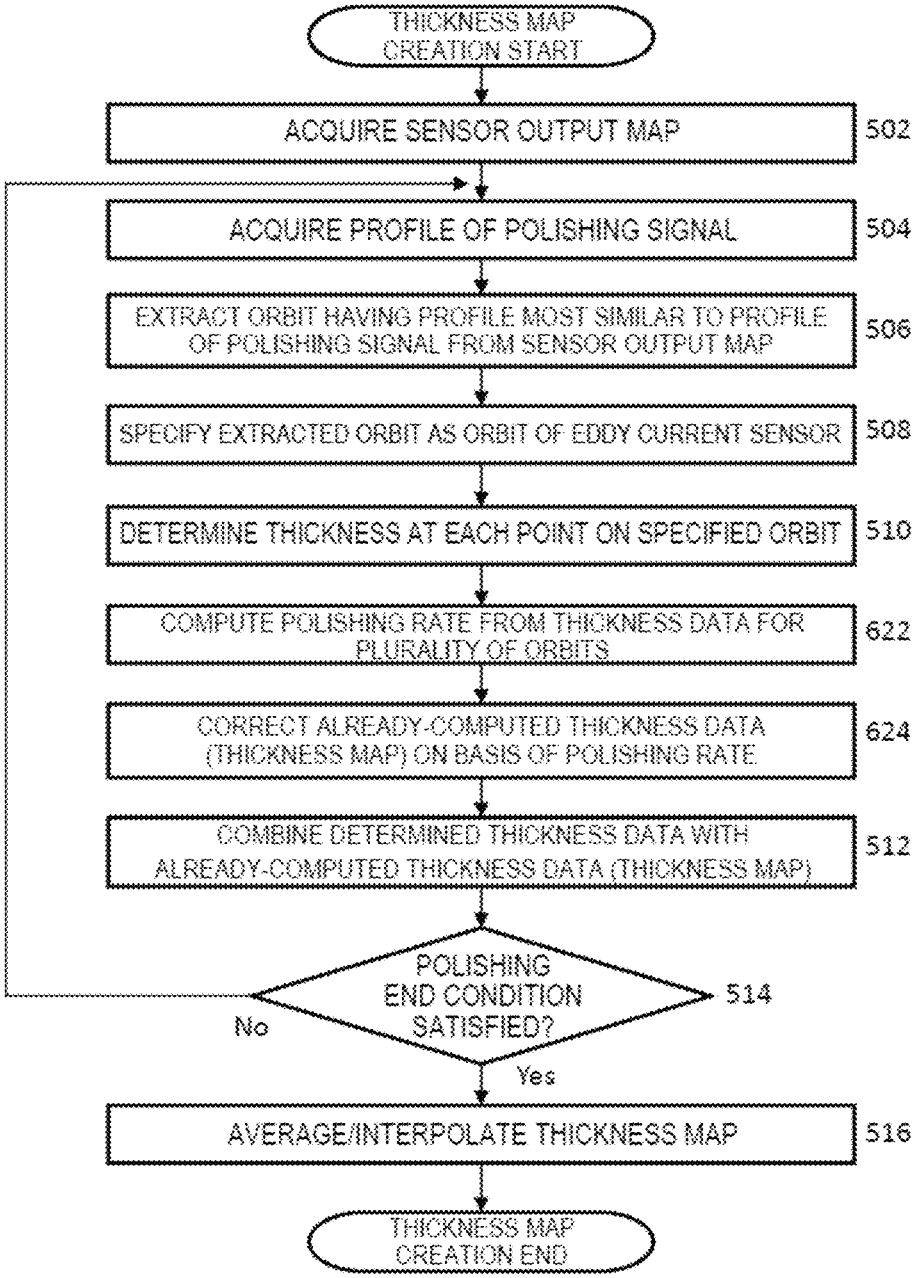
FIG. 6 is a flowchart illustrating a method of creating a polishing thickness map during a polishing treatment according to the embodiment.

FIG. 5 is a flowchart illustrating a method of creating a water polishing thickness map during the water polishing treatment (that is, step 404) according to the embodiment. FIG. 6 is a flowchart illustrating a method of creating a polishing thickness map during the polishing treatment (that is, step 402) according to the embodiment. First, FIG. 5 will be referenced to describe a method of creating the water polishing thickness map (hereinafter also simply referred to as the thickness map).

In step 502, a sensor output map is acquired as three-dimensional data. The acquired sensor output map is stored in the storage device 141. The "sensor output map" is a map expressing the magnitude of the output signal from the eddy current sensor 150 across the entire polished surface of the substrate 121. Consequently, data points in the sensor output map are positioned two-dimensionally on the substrate 121. Because the output signal from the eddy current sensor 150 is recorded at each data point, the sensor output map is three-dimensional data (two dimensions are used to express the position while one dimension is used to express the magnitude of the output signal, for a total of three dimensions).

Note that as described earlier, because the magnitude of the signal output by the eddy current sensor 150 is not determined solely by the thickness of the conductive layer at the surface of the substrate 121, it should be appreciated that the sensor output map is different from a thickness map that expresses the thickness distribution itself on the substrate 121.

Before the substrate 121 is polished in step 504, the sensor output map is generated using the output signal from the eddy current sensor 150 for a different substrate 121 (hereinafter referred to as the reference substrate) of the same type as the substrate 121 to be polished in step 504. Here, a "substrate of the same type" means a "substrate provided with, or at least designed to have, the same interconnect pattern". The sensor output map is generated from the signal output by the eddy current sensor 150 while the CMP apparatus 100 is activated, or more specifically, in the case where the polishing table 110 and the polishing head 120 are made to rotate.

The interval θ between the orbits of the eddy current sensor 150 as seen from the substrate 121 when generating the sensor output map is preferably an interval by which variations in the output signal from the eddy current sensor 150 can be resolved sufficiently. For example, preferably, the rotational speeds of the polishing table 110 and the polishing head 120 when generating the sensor output map are set such that the interval 0 between the orbits of the eddy current sensor 150 as seen from the substrate 121 is 10 degrees or less. For example, in the case where the interval θ between the orbits of the eddy current sensor 150 as seen from the substrate 121 is exactly 2 degrees, the number of orbits is 180 (360 (degrees)/2 (degrees/orbit)=180 (orbits)). By having the eddy current sensor 150 travel along a large number of orbits on the substrate 121, the signal from the eddy current sensor 150 is output for substantially the entire surface of the substrate 121. It is possible to generate and acquire the sensor output map from the output signal for substantially the entire surface of the substrate 121. As another setting, the rotational speed of the polishing table 110 may be set to 60 rpm while the rotational speed of the polishing head 120 may be set to 61 rpm, for example. In this case, θ is approximately 6 degrees. Also, it is known that during the polishing of the substrate 121, the substrate 121 may rotate inside or on the polishing head 120. In cases where this rotation phenomenon of the substrate 121 may occur, the rotation phenomenon of the substrate 121 may be considered when calculating θ. For example, the rotation speed of the substrate 121 may be calculated according to the formula (revolutions of polishing head 120)×(inner diameter of polishing head 120)/(outer diameter of substrate 121). Also, when generating and acquiring the sensor output map, a plurality of combinations of the rotational speeds of the polishing table 110 and the polishing head 120 may be used.

In this way, the sensor output map preferably has a resolution (number of data points) by which variations in the output signal from the eddy current sensor 150 can be resolved sufficiently. For example, although dependent on factors such as the size of the substrate 121 and the shape of the interconnects on the substrate 121, the number of data points in the sensor output map is preferably 100 points by 100 points or more, more preferably 1000 points by 1000 points. However, the data points in the sensor output map may also be expressed in rθ coordinates or some other coordinates rather than in xy coordinates.

To generate the sensor output map, it is necessary to make the eddy current sensor 150 travel along a plurality of orbits. To make the eddy current sensor 150 travel along a plurality of orbits, it is necessary to rotate the polishing table 110 many times. For example, in the case where θ is exactly 2 degrees, it is necessary to rotate the polishing table 110 at least 180 times. In the case where an abrasive exists on the polishing pad 111, the polishing of the substrate 121 progresses while the polishing table 110 is rotating many times. If the polishing of the substrate 121 progresses when acquiring the sensor output map, an accurate sensor output map cannot be acquired. Consequently, the acquisition of the sensor output map is preferably executed under conditions in which the substrate 121 is not substantially polished.

To avoid substantially polishing the substrate 121, it is necessary to remove the abrasive on the polishing pad 111 and keep the polishing pad 111 in a clean state. To remove the abrasive on the polishing pad 111 and keep the polishing pad 111 in a clean state, water (pure water) may be supplied from the liquid supplying mechanism 130 to the polishing pad 111 while the sensor output map is acquired. In the case where a clean polishing pad 111 is used and the polishing pad 111 itself does not have polishing ability, the substrate 121 is unlikely to be polished substantially. Strictly speaking, however, because the substrate 121 and the polishing pad 111 are in contact, there is a possibility that the substrate 121 will be polished (abraded) even in the case of using a clean polishing pad 111. However, the polishing amount of the substrate 121 in a clean environment is considered to be small enough to ignore.

In the case where the polishing pad 111 itself has polishing ability, such as when abrasive grains are embedded in the polishing pad 111, the substrate 121 may be polished even if the polishing pad 111 is kept clean. In this case, the sensor output map is acquired after removing the polishing pad 111 attached to the polishing table 110 and attaching a polishing pad 111 that does not have polishing ability to the polishing table 110. After the sensor output map is acquired, the polishing pad 111 is replaced again (returned to the original configuration).

Figure 7:
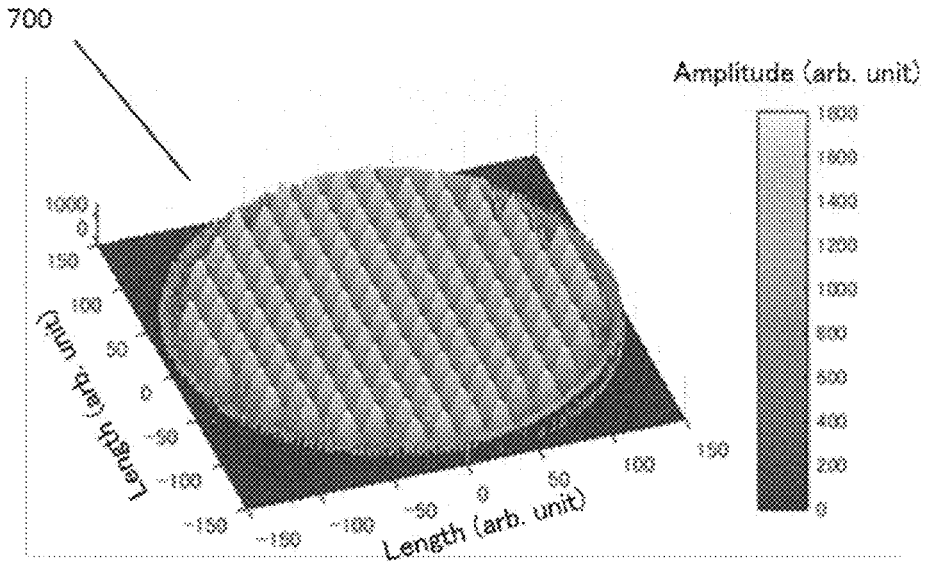
FIG. 7 is a diagram illustrating an example of a sensor output map.

An example of a sensor output map 700 acquired according to the method described above is illustrated in FIG. 7. As FIG. 7 demonstrates, a sensor output map 700 has periodic unevenness. This is because a periodic pattern is formed in the substrate 121 used to generate the sensor output map 700.

The values of the signal output from the eddy current sensor 150 (or the values of the signal that should be output from the eddy current sensor 150) can be profiled on a line of any shape drawn on the acquired sensor output map (for example, the sensor output map 700). In other words, the profile of any orbit can be computed from the acquired sensor output map.

In step 504, the profile of a polishing signal while the substrate 121 is being polished is acquired as two-dimensional data. More specifically, step 504 is divided into a step of polishing the substrate 121 with the substrate 121 pressed against the polishing table 110 while also rotating the polishing head 120 with the substrate 121 attached thereto and the polishing table 110, and a step of acquiring the profile of the polishing signal as two-dimensional data. Here, the "polishing signal" refers to the signal output by the eddy current sensor 150 while the substrate 121 is being polished due to the rotation of the polishing table 110 and the polishing head 120. Here, a "profile" refers to two-dimensional data plotting the magnitude of the output signal of the eddy current sensor 150 on a certain orbit (one dimension is used to indicate the position on the orbit and one dimension expresses the magnitude of the output signal, for a total of two dimensions). After acquiring the sensor output map in step 502, the controller 140 activates the CMP apparatus 100 and acquires the signal (polishing signal) output from the eddy current sensor 150 while the substrate 121 is being polished. The profile of the polishing signal preferably has a number of data points by which variations in the output signal from the eddy current sensor 150 can be resolved sufficiently. Although dependent on factors such as the length of the orbit and the shape of the interconnects on the substrate 121, the number of data points on a single profile is preferably 10 points or more. More preferably, the number of data points on a single profile is 100 points or more.

In step 506, the orbit having a profile that is most similar to the profile of the polishing signal from the eddy current sensor 150 is extracted from the sensor output map. Also, in step 508, the extracted orbit is specified as the orbit of the eddy current sensor 150 as seen from the substrate 121. The controller 140 reads out the sensor output map from the storage device 141 or the like, and extracts, from the sensor output map, the orbit having the profile that is most similar to the profile of the polishing signal from the eddy current sensor 150. Insofar as the polishing of the substrate 121 does not progress excessively, the signal from the eddy current sensor 150 obtained from the same orbit is considered to be similar even if the polishing of the substrate 121 progresses. Consequently, the extracted orbit can be specified as the orbit of the eddy current sensor 150 as seen from the substrate 121.

The signal from the eddy current sensor 150 depends at least partially on the thickness of the conductive layer at the surface of the substrate 121. Consequently, the polishing signal from the eddy current sensor 150 increases or decreases depending on how far the polishing of the substrate 121 has progressed. For this reason, there is a possibility that the magnitude of the signal from the eddy current sensor 150 when the sensor output map was acquired may be different from the magnitude of the polishing signal from the eddy current sensor 150. Accordingly, in step 506, both the magnitude of the signal from the eddy current sensor 150 when the sensor output map was acquired and the magnitude of the signal from the eddy current sensor 150 when the polishing signal was acquired may be normalized. Normalization makes it possible to perform simple addition or subtraction on a profile cut out from the sensor output map and the profile of the polishing signal. For example, by taking the sum of the differences between the profile on a certain orbit in the sensor output map from the eddy current sensor 150 and the profile of the polishing signal from the eddy current sensor 150, the similarity between the two profiles can be determined. For example, the two profiles are determined to be most similar when the sum of the differences is minimized. As another method, the similarly may be determined by comparing at least one of the peak shape, peak position, or peak size of the profile on a certain orbit in the sensor output map to at least one of the peak shape, peak position, or peak size of the profile of the polishing signal from the eddy current sensor 150 for example. Otherwise, any known method for determining the similarity between profiles may also be used.

Figure 8:
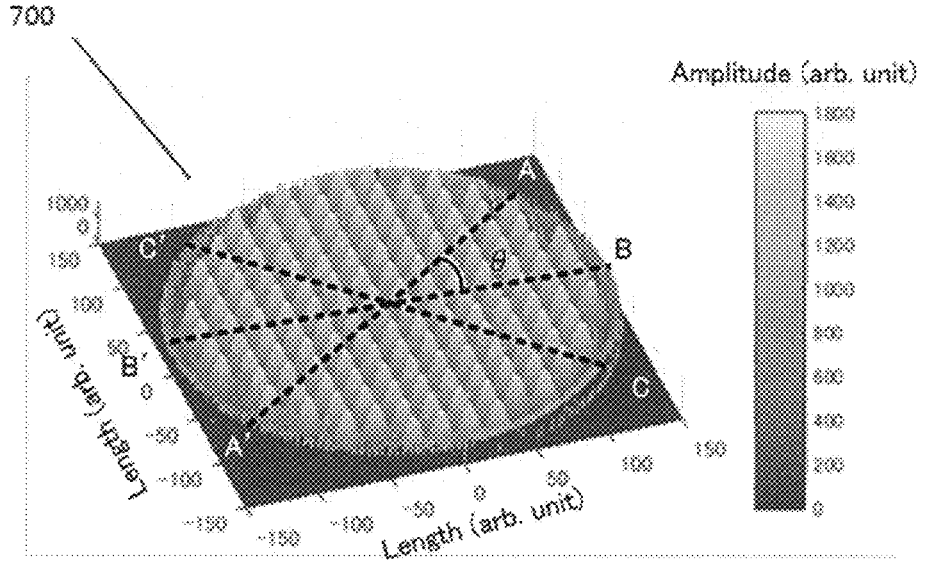
FIG. 8 is a diagram illustrating a sensor output map for explaining steps 506 and 508.
Figure 9:
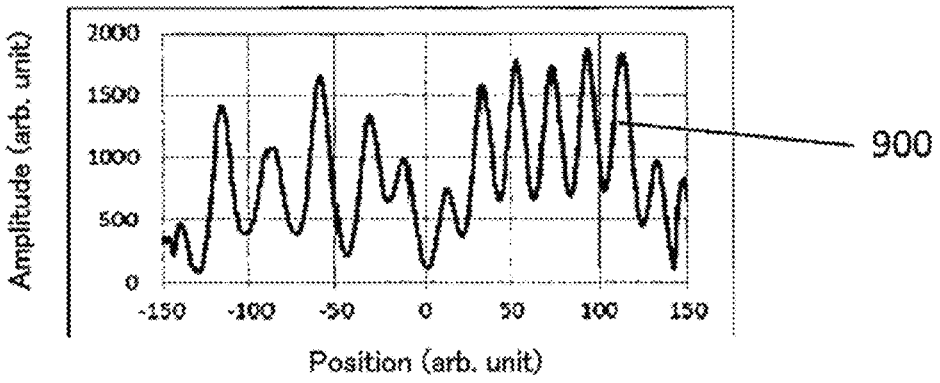
FIG. 9 is a diagram illustrating a profile of a polishing signal used for explanation.

Step 506 and step 508 will be described further by taking the sensor output map 700 as an example. As an example, the profiles on an orbit A-A', an orbit B-B', and an orbit C-C' are cut out from the sensor output map 700 in FIG. 8. As described later, the angle interval θ between orbits (between profiles) may be 0.1 degrees or less, and the number of cut-out profiles may be four or more. Furthermore, as described later, the shape of each orbit may also be curved. It should be appreciated that the orbits illustrated in FIG. 8 are merely examples for the sake of explanation. Also, in step 504, it is assumed that a profile 900 of the polishing signal as illustrated in FIG. 9 is obtained.

Figure 10:
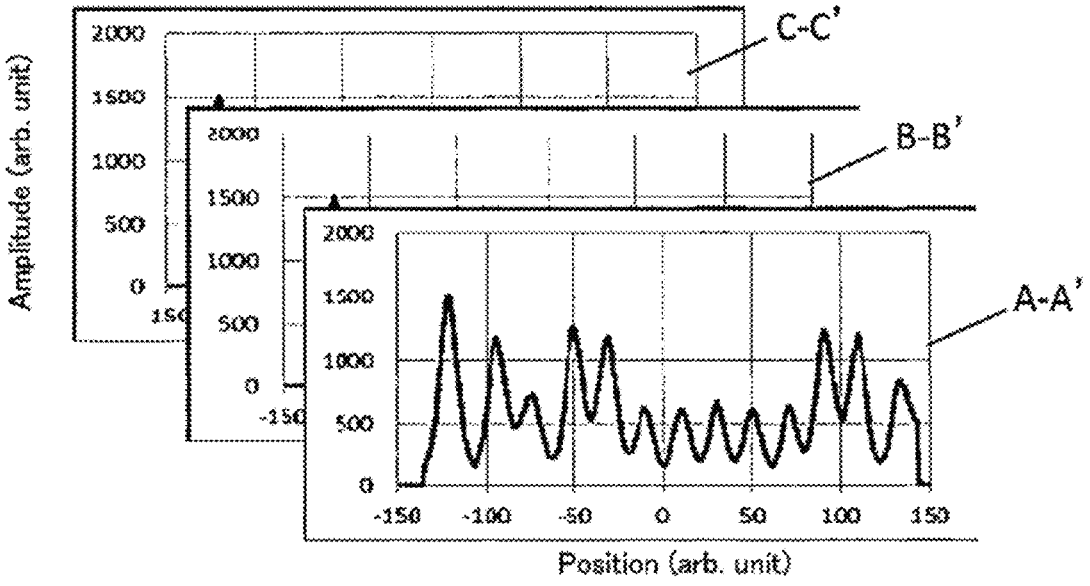
FIG. 10 is a diagram illustrating profiles A-A', B-B', and C-C'.

The controller 140 acquires the profile on each orbit of the sensor output map 700. In this example, there are three orbits as illustrated in FIG. 8. Consequently, in this example, three profiles of the sensor output map 700 are acquired as illustrated in FIG. 10 (the profile A-A', the profile B-B', and the profile C-C', where "profile X-X'" means "the profile on the orbit X-X' of the sensor output map 700"). Note that the profiles in FIG. 10 do not strictly reproduce the profiles of the sensor output map 700 in FIG. 8. It should be understood that the differences between FIG. 8 and FIG. 10 occur merely out of convenience in the explanation.

The controller 140 uses any technique for similarity comparison to extract the orbit having the profile that is most similar to the profile 900 of the polishing signal. For example, after normalizing the profile 900 of the polishing signal and the profiles A-A', B-B', and C-C', the controller 140 calculates and/or determines the similarity from the magnitude of the mean squared error. In this example, assume that the profile C-C' is calculated as being the most similar to the profile 900 of the polishing signal. The controller 140 specifies the extracted orbit C-C' as the orbit of the eddy current sensor 150 as seen from the substrate 121.

When comparing the similarities of the profiles, the interval between the profiles cut out from the sensor output map is preferably as small as possible. In the embodiment, profiles are cut out from the sensor output map such that the interval θ between the orbits of the eddy current sensor 150 as seen from the substrate 121 is 0.1 degrees or less. Consequently, in the case where the symmetry of the interconnect pattern described later is not considered, 3600 profiles (360 (degrees)/0.1 (degrees)=3600 (dimensionless)) are compared to the profile of the polishing signal from the eddy current sensor 150.

In the case where the interconnect pattern on the substrate 121 has rotational symmetry, profiles on symmetric orbits have substantially the same values. Consequently, in the case where the interconnect pattern has rotational symmetry, the number of profiles to compare may be reduced according to the symmetry. For example, in the case where the interconnect pattern has rotational symmetry of order 2, the range in which profiles are cut out from the sensor output map may be a range of 180 degrees. Similarly, the range may be 120 degrees for rotational symmetry of order 3, 90 degrees for rotational symmetry of order 4, and 360/n degrees for rotational symmetry of order n.

Note that the interval between profiles when cutting out profiles from the sensor output map may be different from the interval θ between orbits of the eddy current sensor 150 when acquiring the sensor output map. Profiles on any orbit can be cut out from the sensor output map, irrespectively of the orbits of the eddy current sensor 150 when acquiring the sensor output map.

Additionally, an orbit extracted from the sensor output map may be curved. This is because, as illustrated in FIG. 3, the actual orbits of the eddy current sensor 150 may be curved. The shape (such as the curvature) of the extracted orbit may be computed from properties such as the shapes, the positional relationship, and the rotational speeds of the polishing table 110 and the polishing head 120.

When an orbit of the eddy current sensor 150 is specified as described above, next, in step 510, the thickness at each point on the specified orbit is determined. The thickness t(x, y) at each point on an orbit of the eddy current sensor 150 can be determined according to the following formula on the basis of an initial thickness $t_i(x, y)$, a final thickness $t_f(x, y)$, and a polishing progress $\alpha(x, y)$ at the position (x, y) on the substrate 121.

$$t(x, y)=t_i(x, y)^{\prime}\{t_i(x, y)-t_f(x, y)\}\times\alpha a(x, y)$$

The initial thickness $t_i(x, y)$ indicates the thickness in the initial state before polishing the substrate 121 (note that even in the initial state, an in-plane distribution of thickness may exist due to features such as interconnects formed on the substrate 121). The final thickness $t_f(x, y)$ indicates the thickness in the state after polishing the substrate 121 until a target thickness and thickness distribution is reached. The initial thickness $t_i(x, y)$ and the final thickness $t_f(x, y)$ may be stored respectively in the storage device 141 as an initial thickness map and a final thickness map, for example. Similarly to the sensor output map described earlier, the initial thickness map and the final thickness map may be generated before the substrate 121 is polished in step 504 by performing a thickness measurement on a reference substrate, which is a different substrate 121 of the same type as the substrate 121 to be polished in step 504. To perform the thickness measurement for generating the initial thickness map and the final thickness map, it is preferable to use an optical thickness measuring instrument, for example. By using an optical thickness measuring instrument, it is possible to obtain the initial thickness and the final thickness at each point on the substrate 121 at a relatively high spatial resolution.

The polishing progress $\alpha(x, y)$ is an indicator that indicates how far the polishing of the substrate 121 (the substrate 121 that is actually polished in step 504) has progressed. For example, the polishing progress $\alpha(x, y)$ may be defined to take a value of 0 (zero) in the initial state before polishing the substrate 121, to take a value of 1 in the final state when a target thickness has been reached by polishing, and to take an intermediate value between 0 and 1 in a state between the initial state and the final state, the intermediate value increasing as the state approaches the final state. The polishing progress $\alpha(x, y)$ can be computed on the basis of the polishing signal acquired in step 504.

Figure 17:
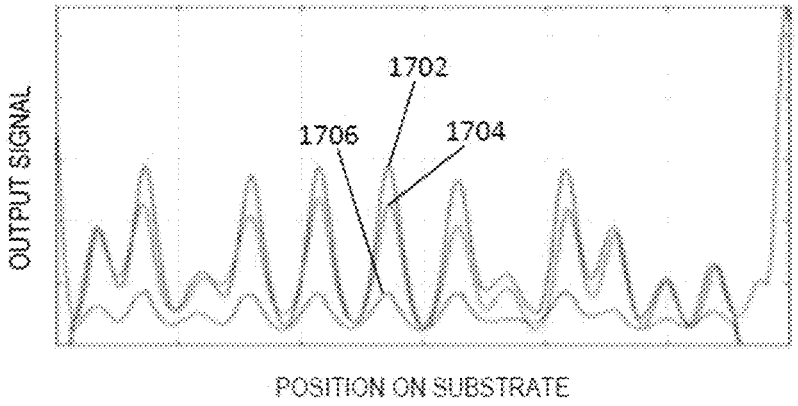
FIG. 17 is a diagram illustrating an example of a method of computing the polishing progress on the basis of a polishing signal.

FIG. 17 is a diagram illustrating an example of a method of computing the polishing progress $\alpha(x, y)$ on the basis of a polishing signal. In FIG. 17, the horizontal axis represents the position on the substrate 121 (for example, the position on an orbit of the eddy current sensor 150 specified in step 508), and the vertical axis represents the magnitude of the output signal from the eddy current sensor 150. FIG. 17 illustrates a polishing signal 1704 acquired while the substrate 121 is being polished in step 504. FIG. 17 additionally illustrates an output signal 1702 from the eddy current sensor 150 acquired from a substrate 121 corresponding to the initial state (the reference substrate, that is, a different substrate 121 of the same type as the substrate 121 to be polished in step 504), and an output signal 1706 from the eddy current sensor 150 obtained from a substrate 121 corresponding to the final state (a substrate obtained by polishing the reference substrate, that is, a different substrate 121 of the same type as the substrate 121 to be polished in step 504, under the same polishing conditions as step 504 until the target thickness is achieved). Note that the output signal 1702 in the initial state and the output signal 1706 in the final state may be stored in the storage device 141 in advance as sensor output maps.

Referring to FIG. 17, assume for example that at the position (x, y) on the substrate 121, the polishing signal 1704 has a value V, the output signal 1702 in the initial state has a value Vi, and the output signal 1706 in the final state has a value $V_f$. At this time, the polishing progress at the position (x, y) on the substrate 121 can be computed according to the following formula, for example.

$$\alpha(x, y)=(V_i-V)/(V_i-V_f)$$

Figure 18:
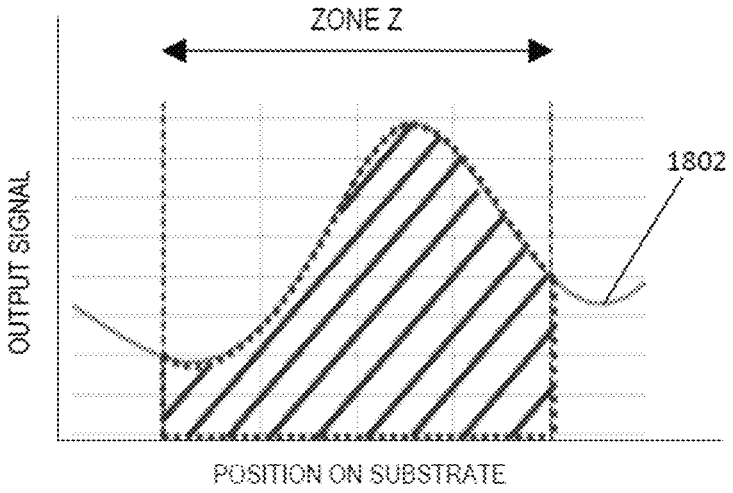
FIG. 18 is a diagram illustrating a different example of a method of computing the polishing progress on the basis of a polishing signal.

FIG. 18 is a diagram illustrating a different example of a method of computing the polishing progress $\alpha(x, y)$ on the basis of a polishing signal. The horizontal and vertical axes in FIG. 18 are similar to FIG. 17. However, the horizontal axis in FIG. 18 is enlarged compared to the horizontal axis in FIG. 17. FIG. 18 illustrates a single signal 1802 that is representative of the polishing signal 1704, the output signal 1702 in the initial state, and the output signal 1706 in the final state in FIG. 17 (in other words, the signal 1802 in FIG. 18 corresponds to any one of the signals 1702, 1704, and 1706).

In FIG. 18, a zone Z of a predetermined range containing the position (x, y) on the substrate 121 is set. For example, the zone Z may be a partial zone of a certain orbit of the eddy current sensor 150 specified in step 508. In the zone Z, the area of the portion enclosed by the curve representing the signal 1802 and the horizontal axis is calculated. For example, assume that S is the area of the portion calculated for the polishing signal 1704, $S_i$ is the area of the portion calculated for the output signal 1702 in the initial state, and $S_f$ is the area of the portion calculated for the output signal 1706 in the final state. At this time, the polishing progress at the position (x, y) on the substrate 121 can be computed according to the following formula, for example.

$$\alpha(x, y)=(S_i-S)/(S_i-S_r)$$

In the above method, the polishing progress $\alpha(x, y)$ is computed on the basis of a proportional calculation of the area of the portion under the curve representing the signal 1802 in the zone Z, but as another method, the polishing progress $\alpha(x, y)$ may also be computed on the basis of a proportional calculation of the peak value of the signal 1802 in the zone Z.

Next, in step 512, the thickness data at each point on the orbit determined in step 510 above is combined with the thickness data at each point on one or a plurality of other orbits already computed, and thereby the thickness map is created or updated. Additionally, in the next step 514, it is determined whether or not a predetermined polishing end condition is satisfied (such as determining whether or not polishing has been performed for a preset polishing time, or determining whether or not the thickness of a predetermined area or the average value of the thickness of each area on the substrate 121 is in a predetermined range, for example), and if the predetermined polishing end condition has not been satisfied yet, the process is repeated from step 504 again.

To describe the process in step 512 specifically, FIG. 3 will be referenced again for convenience. In FIG. 3, ten orbits 1 to 10 are drawn. For example, assume that by a certain point in time, the process from step 504 to step 512 has already been performed twice, and as a result, thickness data at each point on the two orbits 1 and 2 has been computed and stored in the storage device 141. This thickness data forms a thickness map in the partial area corresponding to the above two orbits out of the entire substrate 121. Furthermore, assume that by executing step 510 for a third time at this point, thickness data at each point on the orbit 3 is obtained. In step 512, the controller 140 adds the thickness data at each point on the orbit 3 to the thickness map of the partial area corresponding to the orbits 1 and 2, and stores the result in the storage device 141 as a new thickness map. The new thickness map includes thickness data at each point on the three orbits 1, 2, and 3. In this way, by repeating the process from step 504 to step 512 a plurality of times, the thickness map is expanded/updated to cover a broader area of the substrate 121 or the entire substrate 121.

Figure 11:
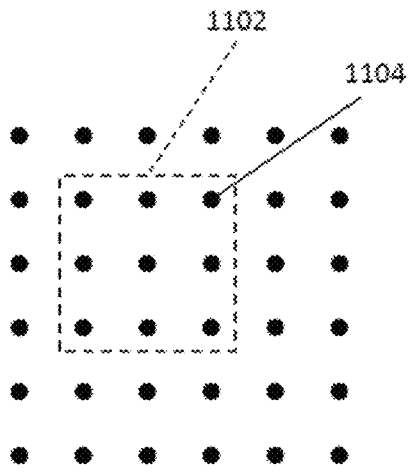
FIG. 11 is a diagram for explaining a process of averaging a thickness map.
Figure 12:
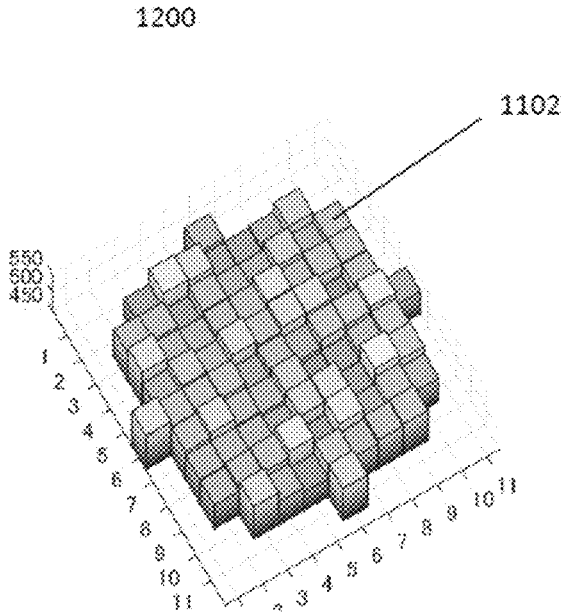
FIG. 12 is a diagram illustrating an example of an averaged thickness map.

When the predetermined polishing end condition is satisfied in the determination in step 514, in the next step 516, an averaging process and an interpolation process are performed on the thickness map created as described above. FIG. 11 is a diagram for explaining the process of averaging the thickness map. As described earlier, the substrate 121 is diced into individual chips (that is, dies) in a later step. On the substrate 121, a plurality of demarcated die areas 1102 are arranged. Although dependent on the shape and size of the die areas 1102, a plurality of points 1104 may exist in the thickness map inside a single die area 1102. Each point 1104 in the thickness map has the thickness data computed in step 510 above at the position corresponding to that point on the substrate 121. Note that the thickness data of each point 1104 may also be corrected according to properties such as a known interconnect pattern at that point 1104. The controller 140 computes a representative value of the thickness of each die area 1102 by averaging the thickness data at the plurality of points 1104 existing inside each die area 1102, and uses the representative value of the thickness of each die area 1102 computed in this way to create an averaged thickness map. FIG. 12 is a diagram illustrating an example 1200 of an averaged thickness map. As FIG. 12 demonstrates, the averaged thickness map 1200 is expressed as having a constant thickness for each die area 1102.

Figure 13:
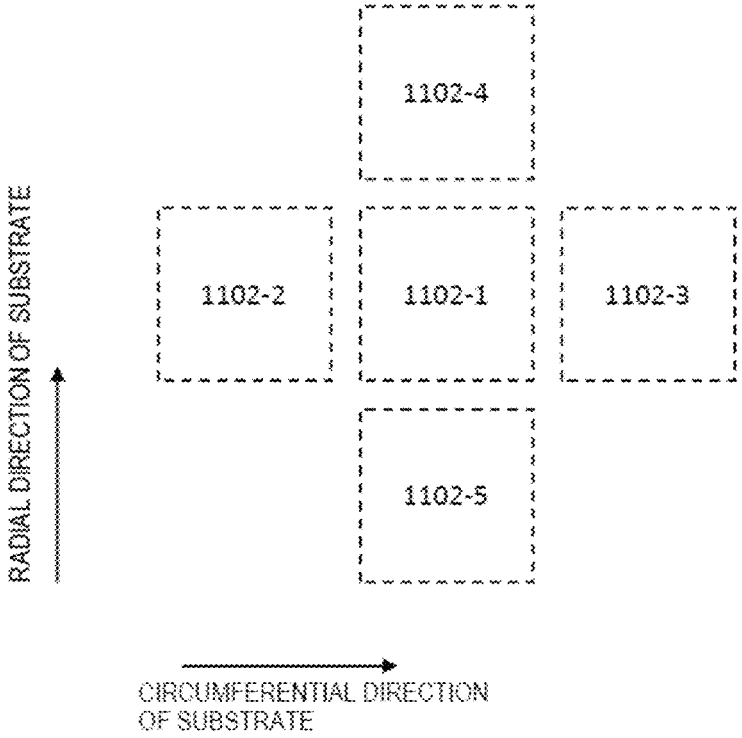
FIG. 13 is a diagram for explaining a process of interpolating a thickness map.

FIG. 13 is a diagram for explaining the process of interpolating the thickness map in step 516. As described above, the thickness at each point on orbits of the eddy current sensor 150 is computed, and a thickness map is constructed from the thickness data at each point. Consequently, thickness data does not exist in the thickness map for areas on the substrate 121 where an orbit of the eddy current sensor 150 does not pass through. The interpolation process in step 516 is a process of interpolating such data by using the data stored in the thickness map.

At this point, it is assumed that a plurality of airbags 122 of the CMP apparatus 100 are provided concentrically with respect to the substrate 121. In this case, because the polishing pressure of the substrate 121 is constant inside each concentric ring, the polished substrate 121 is expected to reach a similar polished state throughout the circumferential direction of each concentric ring. Accordingly, when performing the interpolation process in step 516, by increasing the correlation strength of interpolation in the circumferential direction, the accuracy of the interpolation can be improved.

For example, as illustrated in FIG. 13, assume that four die areas 1102-2, 1102-3, 1102-4, and 1102-5 exist adjacent to a certain die area 1102-1. The die areas 1102-2 and 1102-3 are adjacent to the die area 1102-1 in the circumferential direction of the substrate 121, while the die areas 1102-4 and 1102-5 are adjacent to the die area 1102-1 in the radial direction of the substrate 121. It is assumed that the die area 1102-1 does not have thickness data. On the other hand, it is assumed that the die areas 1102-2, 1102-3, 1102-4, and 1102-5 have thickness data, and the respective thickness values (that is, the representative values described above that are obtained by averaging the thickness at the plurality of points inside each die area) are designated T2, T3, T4, and T5.

The controller 140 computes an average thickness T1 of the die area 1102-1 by interpolating the thickness values T2, T3, T4, and T5 of the four die areas adjacent to the die area 1102-1. To increase the correlation strength of the interpolation in the circumferential direction of the substrate 121 as described above, the following interpolation formula can be used, for example. However, it is assumed that u>v and u+v=½, and the ratio u/v expresses that interpolation in the circumferential direction has a correlation u/v times the correlation in the radial direction of the substrate 121.

$$T1=u(T2+T3)+v(T4+T5)$$

By executing each step according to the flowchart in FIG. 5 as above, the thickness map in the water polishing treatment is completed.

Next, the flowchart in FIG. 6 will be referenced to describe a method of creating a polishing thickness map during the polishing treatment (that is, step 402 in the flowchart in FIG. 4). Hereinafter, the polishing thickness map will also be simply referred to as the thickness map. In the flowchart in FIG. 6, the steps other than steps 622 and 624 are the same as the steps in the flowchart in FIG. 5.

As described above, during the water polishing treatment, because the polishing rate is extremely low, there is little or no progression in the polishing of the substrate 121. Consequently, in the case of creating a thickness map during the water polishing treatment, as described with regard to step 512 in FIG. 5, it is possible to update the thickness map by directly combining the thickness data of a new orbit (for example, the orbit 3) with the already-computed thickness map (for example, the partial thickness map corresponding to the orbits 1 and 2). However, in the polishing treatment in step 402 in FIG. 4, the substrate 121 is being polished at a markedly higher polishing rate than the water polishing, and therefore if the thickness data of a new orbit is simply combined with the already-computed thickness map, thickness data after polishing has progressed to a certain extent will be combined with the thickness map from before the polishing progressed, and a correct thickness map cannot be obtained. To avoid such a situation, the method in the flowchart in FIG. 6 that creates a thickness map during the polishing treatment is performed with the addition of steps 622 and 624.

Figure 14:
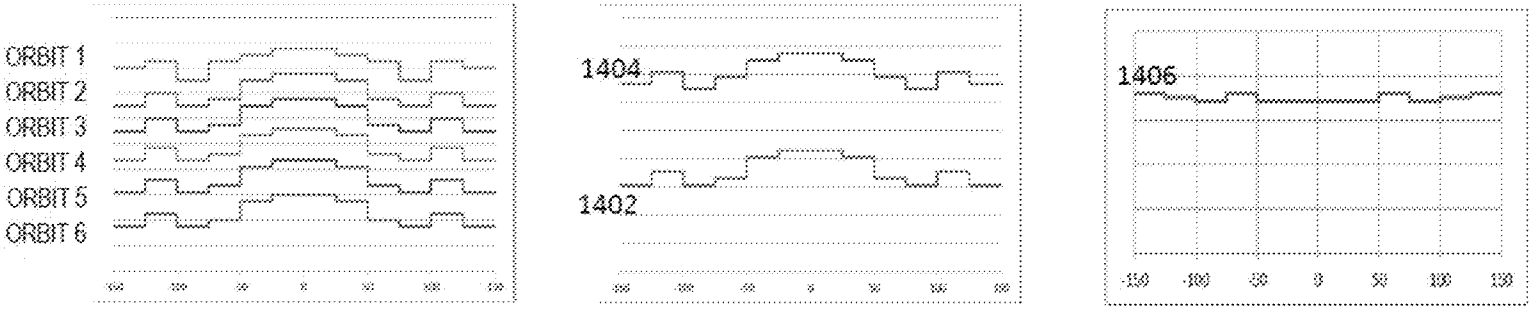
FIG. 14 is a diagram illustrating an example of a method of computing a polishing rate.

In step 622, the polishing rate of the substrate 121 is computed on the basis of thickness data corresponding to a plurality of orbits. FIG. 14 is a diagram illustrating an example of a method of computing the polishing rate. FIG. 14 illustrates a thickness distribution of orbits 1 to 6 (see FIG. 3, for example). Assume that the thickness data of the orbit 1 is acquired first, and the thickness data of each of the orbits 2, 3, 4, 5, and 6 is acquired sequentially thereafter. Because the polishing of the substrate 121 gradually progresses while the thickness data of the orbits 1 to 6 are acquired, the average thickness of each orbit decreases in the order of the orbits 1, 2, 3, 4, 5, and 6. The polishing table 110 rotates once while the thickness data for two neighboring orbits (for example, the orbits 1 and 2) is acquired.

First, the controller 140 computes an average thickness distribution 1402 of three successive orbits including the most recent orbit 6 (in other words, the orbits 4, 5, and 6), and additionally computes an average thickness distribution 1404 of preceding three successive orbits (in other words, the orbits 1, 2, and 3). Next, the controller 140 computes the difference between the two average thickness distributions 1402 and 1404, and by dividing the difference by the number of rotations (in this example, three rotations) of the polishing table 110 between the two average thickness distributions, the controller 140 computes a distribution 1406 of the polishing amount per rotation of the polishing table 110 (in other words, the polishing rate). Note that in the three graphs illustrated in FIG. 14, the horizontal axis represents the position in the radial direction of the substrate 121. By computing the polishing rate from average thickness distributions of three orbits, the polishing rate can be computed precisely. Obviously, the polishing rate may also be computed from average thickness distributions of two orbits or of four or more orbits. Also, instead of using average thickness distributions, the polishing rate may also be computed from the difference between the thickness distribution of a certain orbit and the thickness distribution of another orbit.

Next, in step 624, the polishing rate of the substrate 121 obtained in step 622 above is used to correct the thickness data in each orbit already computed (that is, the thickness map that has been created up to the current point in time). After that, in step 512 described earlier, the corrected thickness data (or thickness map) and the thickness data of the orbit determined in step 510 are combined.

For example, assume that at a certain point in time, a thickness map corresponding to the entire surface of the substrate 121 is obtained. In step 624, the controller 140 subtracts the polishing amount indicated by the distribution 1406 of the polishing rate obtained in step 622 from the thickness map. Because the distribution 1406 of the polishing rate is a distribution in the radial direction of the substrate 121, the amount subtracted from the thickness map is the same amount in the circumferential direction of the substrate 121. In other words, the subtraction from the thickness map is performed concentrically. The thickness map after subtraction is a corrected thickness map reflecting that the polishing of the substrate 121 has progressed from the point in time at which the pre-subtraction thickness map was acquired until the current point in time. Consequently, in the next step 512, by combining the corrected thickness map with the thickness data of the orbit computed in the current step 510, the thickness map can be updated correctly.

The thickness map updated while accounting for the polishing rate of the substrate 121 in this way is averaged and interpolated in step 516, similarly to the case of water polishing described above, and then an averaged thickness map having an average thickness for each die area 1102 (for example, an averaged thickness map 1200 like the one illustrated in FIG. 12) is obtained.

By executing each step according to the flowchart in FIG. 6 as above, the thickness map in the polishing treatment is completed.

Figure 15:
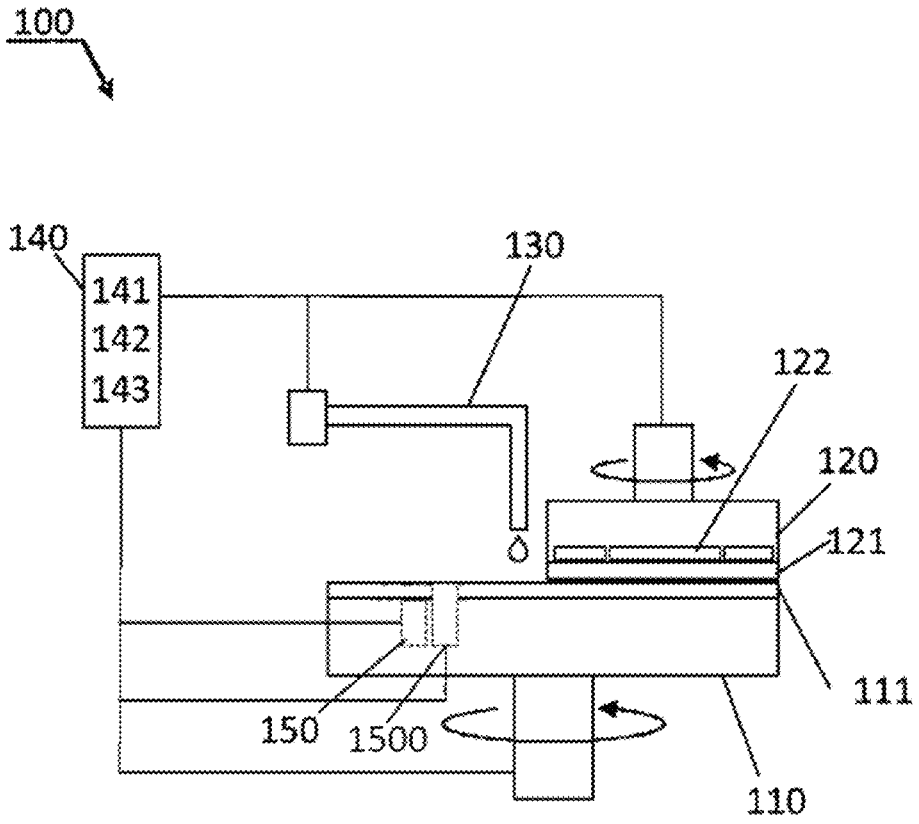
FIG. 15 is a front view of a substrate polishing apparatus according to another embodiment.

FIG. 15 is a front view of a substrate polishing apparatus 100 according to another embodiment. The substrate polishing apparatus 100 according to the embodiment is further provided with an optical sensor 1500 in addition to the configuration illustrated in FIG. 2. As illustrated in the diagram, the optical sensor 1500 is provided in the polishing table 110. The optical sensor 1500 may be provided at any position in the polishing table 110 insofar as the substrate 121 is measurable from that position.

The optical sensor 1500 irradiates the polished surface of the substrate 121 with irradiating light, and measures the optical properties of reflected light reflected by the polished surface of the substrate 121. The optical sensor 1500 measures the optical spectrum of the substrate 121, for example. As described earlier, the polished surface of the substrate 121 is demarcated into a plurality of die areas 1102. Each die area 1102 has a unique film structure and interconnect pattern, and for this reason, the light reflected from each part of each die area 1102 has a characteristic spectrum. Consequently, by using the optical spectrum from the substrate 121 measured by the optical sensor 1500, it is possible to create thickness maps during the polishing and water polishing of the substrate 121, similarly to the methods illustrated by the flowcharts in FIGS. 5 and 6 described above.

In the embodiment of FIG. 15, the substrate polishing apparatus 100 is provided with both the eddy current sensor 150 and the optical sensor 1500. Consequently, the substrate polishing apparatus 100 is capable of creating both a thickness map of the substrate 121 based on the signal from the eddy current sensor 150 and a thickness map of the substrate 121 based on the signal from the optical sensor 1500. As described earlier, the eddy current sensor 150 detects impedance changes caused by inducing an eddy current in the conductive layer at the surface of the substrate 121. Accordingly, the thickness map created on the basis of the signal from the eddy current sensor 150 expresses a distribution of the thickness of the conductive layer, or in other words the metal layer, on the substrate 121. On the other hand, the thickness map created on the basis of the signal from the optical sensor 1500 expresses a distribution of the thickness of the oxide film on the substrate 121.

Figure 16:
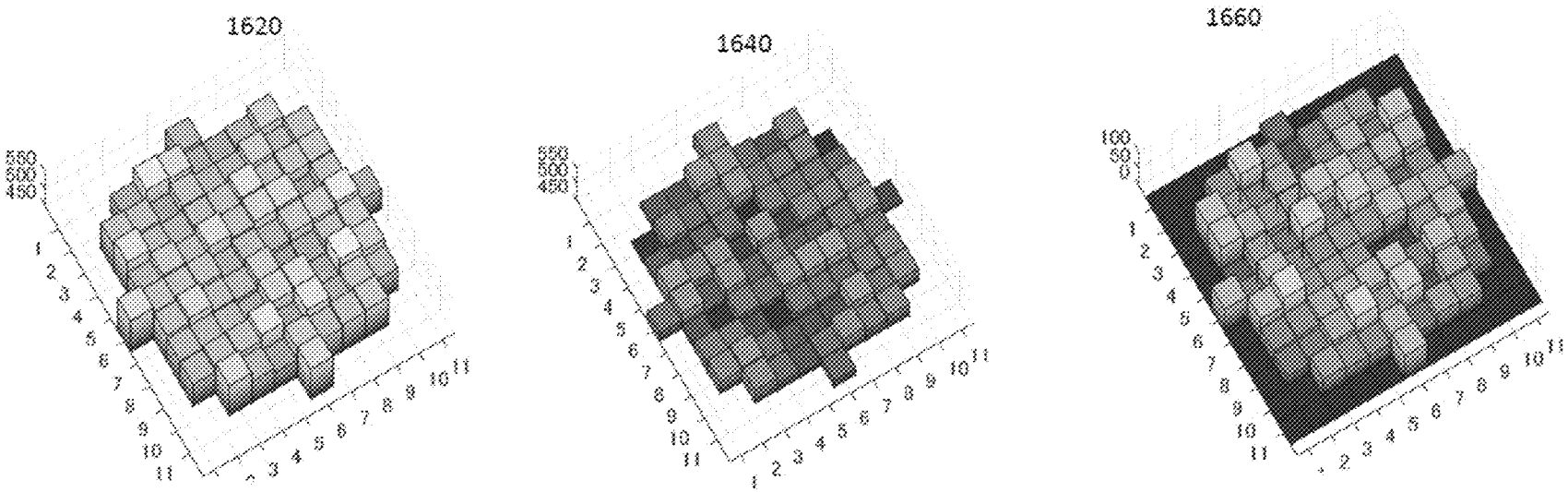
FIG. 16 is a diagram for explaining the creation of a map expressing a distribution of dishing on a substrate.

FIG. 16 illustrates an example 1620 of a thickness map obtained by using the eddy current sensor 150 and an example 1640 of a thickness map obtained by using the optical sensor 1500. In each of the thickness maps 1620 and 1640, the thickness is averaged for each die area 1102. By subtracting the thickness map 1640 according to the optical sensor 1500 from the thickness map 1620 according to the eddy current sensor 150 in each die area 1102 on the basis of the two thickness maps 1620 and 1640, for example, a dishing map 1660 that expresses a distribution of the amount of dishing on the substrate 121 can be created. On the basis of the dishing map 1660, it is determined whether or not a desired amount of dishing has been achieved, and in the case where the desired amount of dishing has not been achieved, a repolishing treatment may be performed. Also, on the basis of the dishing map 1660, the parameters of subsequent polishing cycles (such as the pressure that presses the substrate 121 against the polishing table, the rotational speed of the polishing table and the polishing head that holds the substrate 121, the amount of slurry supplied to the surface of the substrate 121 to be polished, and the temperature of the surface of the substrate 121 to be polished) may be optimized.

On the basis of the thickness maps or the dishing map created as described above, the controller 140 of the substrate polishing apparatus 100 may also determine the treatment parameters in previous steps, determine the treatment parameters in next steps, or perform data processing for quality management, such as yield management.

The foregoing describes several embodiments of the present invention. However, the foregoing embodiments are for facilitating the understanding of the present invention, and do not limit the present invention. The present invention may be modified and improved without departing from the scope of the invention, and any equivalents obtained through such modification and improvement obviously are included in the present invention. Furthermore, any combination or omission of the components described in the claims and the specification is possible insofar as at least one or some of the issues described above can be addressed, or insofar as at least one or some of the effects are exhibited.

REFERENCE SIGNS LIST

100A substrate polishing apparatus
100B substrate polishing apparatus

100C-1 substrate polishing apparatus
100C-2 substrate polishing apparatus
101 polishing chamber
101A polishing chamber
101B polishing chamber
110 polishing table
111 polishing pad
120 polishing head
121 substrate
122 airbag
130 liquid supplying mechanism
140 controller
141 storage device
142 processor
143 input/output device
150 thickness measuring instrument
700 sensor output map
900 profile of polishing signal
1102 die area
1104 each point in thickness map
1200 averaged thickness map
1402 average thickness distribution
1404 average thickness distribution
1406 distribution of polishing rate
1500 optical sensor
1620 thickness map
1640 thickness map
1660 dishing map
1702 output signal in initial state
1704 polishing signal
1706 output signal in final state
1802 signal

What is claimed is:

1. A substrate polishing apparatus comprising:

a rotatably configured polishing table provided with a sensor that outputs a signal related to a thickness;

a rotatably configured polishing head that faces the polishing table, a substrate being attachable to a face of the polishing head that faces the polishing table; and a controller, wherein the controller:

generates, by use of output signals from the sensor for a reference substrate, a sensor output map representing a magnitude of the output signals from the sensor across an entire polished surface of the reference substrate, acquires a polishing signal from the sensor when the sensor passes over a surface to be polished of the substrate, extracts, from the sensor output map, an orbit having a profile that is most similar to a profile of the polishing signal to specify the extracted orbit as an orbit of the sensor with respect to the substrate, calculates a thickness of the substrate at each point on the specified orbit of the sensor on a basis of the polishing signal, and creates a thickness map on a basis of the calculated thickness at each point on a plurality of orbits of the sensor.

2. The substrate polishing apparatus according to claim 1, wherein the sensor is one or a plurality of eddy current sensors.

3. The substrate polishing apparatus according to claim 2, wherein the controller additionally:

calculates a polishing progress of the substrate based at least on the polishing signal.

4. The substrate polishing apparatus according to claim 3, wherein the controller calculates the polishing progress on a basis of a comparison of the polishing signal from the sensor acquired while polishing the substrate, an output signal from the sensor with respect to the reference substrate in an initial state, and an output signal from the sensor with respect to the reference substrate in a final state.

5. The substrate polishing apparatus according to claim 3, wherein the controller calculates the thickness at each point of the substrate on a basis of the calculated polishing progress.

6. The substrate polishing apparatus according to claim 5, wherein the calculated thickness is further based on an initial thickness and a final thickness of the reference substrate wherein the initial thickness and the final thickness have been obtained through thickness measurements on the reference substrate before polishing the substrate.

7. The substrate polishing apparatus according to claim 1, wherein the sensor is one or a plurality of optical sensors.

8. The substrate polishing apparatus according to claim 1, wherein the sensor is one or a plurality of eddy current sensors and one or a plurality of optical sensors.

9. The substrate polishing apparatus according to claim 8, wherein the controller additionally creates a dishing map that expresses a distribution of a dishing amount of the substrate on a basis of a comparison between a first thickness map created using a signal from the one or plurality of eddy current sensors and a second thickness map created using a signal from the one or plurality of optical sensors.

10. The substrate polishing apparatus according to claim 9, wherein the controller additionally:

determines whether or not a desired dishing amount has been achieved on a basis of the dishing map, and in a case where the desired dishing amount has not been achieved, the controller causes the substrate to be repolished using the polishing table and the polishing head, a second polishing table and a second polishing head provided with the substrate polishing apparatus, or a third polishing table and a third polishing head provided with another substrate polishing apparatus different from the substrate polishing apparatus.

11. The substrate polishing apparatus according to claim 9, wherein the controller additionally determines a treatment parameter of a previous step, determines a treatment parameter of a next step, or performs data processing for quality management on a basis of the thickness map or the dishing map.

12. The substrate polishing apparatus according to claim 9, wherein the controller additionally optimizes a polishing parameter on a basis of the thickness map or the dishing map.

13. The substrate polishing apparatus according to claim 1, wherein the controller acquires the polishing signal from the sensor during a water polishing treatment performed after polishing the substrate.

14. The substrate polishing apparatus according to claim 1, wherein the controller acquires the polishing signal from the sensor while polishing the substrate.

15. The substrate polishing apparatus according to claim 1, wherein the controller additionally:

calculates a polishing rate distribution of the substrate based on a thickness distribution of a plurality of orbits of the sensor, calculates a polishing amount of the substrate that is polished during a predetermined time period on a basis of the polishing rate distribution, and updates the thickness map by subtracting the polishing amount from the thickness map that has been created at a predetermined point in time and combining the subtracted thickness map with thickness data corresponding to a current orbit.

16. The substrate polishing apparatus according to claim 1, wherein the controller additionally:

determines whether or not a desired thickness or a desired thickness profile has been achieved on a basis of the thickness map, and in a case where the desired thickness or thickness profile has not been achieved, the controller causes the substrate to be repolished using the polishing table and the polishing head, a second polishing table and a second polishing head provided with the substrate polishing apparatus, or a third polishing table and a third polishing head provided with another substrate polishing apparatus different from the substrate polishing apparatus.

17. The substrate polishing apparatus according to claim 1, further comprising:

an airbag configured to adjust a polishing pressure of the substrate, wherein the controller additionally controls an internal pressure of the airbag on a basis of the thickness map.

18. A method of creating a thickness map of a substrate, executed by a substrate polishing apparatus provided with:

a rotatably configured polishing table provided with a sensor that outputs a signal related to a thickness, and a rotatably configured polishing head that faces the polishing table, the substrate being attachable to a face of the polishing head that faces the polishing table, the method comprising:

generating, by use of output signals from the sensor for a reference substrate, a sensor output map representing a magnitude of the output signals from the sensor across an entire polished surface of the reference substrate;

acquiring a polishing signal from the sensor when the sensor passes over a surface to be polished of the substrate;

extracting, from the sensor output map, an orbit having a profile that is most similar to a profile of the polishing signal to specify the extracted orbit as an orbit of the sensor with respect to the substrate;

calculating a thickness of the substrate at each point on the specified orbit of the sensor on a basis of the polishing signal; and creating the thickness map on a basis of the calculated thickness at each point on a plurality of orbits of the sensor.

19. A method of polishing a substrate, executed by a substrate polishing apparatus provided with:

a rotatably configured polishing table provided with a sensor that outputs a signal related to a thickness, and a rotatably configured polishing head that faces the polishing table, the substrate being attachable to a face of the polishing head that faces the polishing table, the method comprising:

generating, by use of output signals from the sensor for a reference substrate, a sensor output map representing a magnitude of the output signals from the sensor across an entire polished surface of the reference substrate;

rotating the polishing table;

rotating the polishing head having the substrate attached thereto;

polishing the substrate with the substrate pressed against the polishing table;

acquiring a polishing signal from the sensor when the sensor passes over a surface to be polished of the substrate;

extracting, from the sensor output map, an orbit having a profile that is most similar to a profile of the polishing signal to specify the extracted orbit as an orbit of the sensor with respect to the substrate;

calculating a thickness of the substrate at each point on the specified orbit of the sensor on a basis of the polishing signal; and creating a thickness map on a basis of the calculated thickness at each point on a plurality of orbits of the sensor.

* * * * *